US006000588A

United States Patent [19]

Kolton et al.

[11] Patent Number: 6,000,588

[45] Date of Patent: Dec. 14, 1999

[54] HANGER FOR PLURAL PART GARMENTS

[75] Inventors: Chester Kolton, Westfield; Michael Norman, East Brunswick, both of N.J.

[73] Assignee: B&G Plastics, Inc., Newark, N.J.

[21] Appl. No.: 09/174,135

[22] Filed: Oct. 16, 1998

Related U.S. Application Data

[63] Continuation-in-part of application No. 09/088,642, Jun. 2, 1998.

[51] Int. Cl.[6] ..... A41D 27/22

[52] U.S. Cl. ..... 223/88; 223/85; 223/91

[58] Field of Search ..... 223/85, 88, 92, 223/91, 93, 95, 96

[56] References Cited

U.S. PATENT DOCUMENTS

| | | | |
|---|---|---|---|
| D. 204,175 | 3/1966 | Zuckerman | 223/88 |
| 3,317,096 | 5/1967 | Bissonette et al. | 223/95 |
| 3,406,882 | 10/1968 | Phillips | 223/88 |
| 4,438,874 | 3/1984 | Zuckerman et al. | 223/88 |
| 4,703,878 | 11/1987 | Louw | 223/95 |
| 4,774,496 | 9/1988 | Blanchard et al. | 223/96 |
| 4,871,097 | 10/1989 | Blanchard et al. | 223/85 |

*Primary Examiner*—Bibhu Mohanty
*Attorney, Agent, or Firm*—Robin, Blecker & Daley

[57] ABSTRACT

An upstanding garment hanger comprises a transversely extending first support member and a succession of garment support elements depending downwardly from the support member to free ends, at least first and second adjacent ones of the garment support elements defining transversely extending, vertically spaced projections upwardly of the free ends thereof, and a transversely extending second support member joined with upper ends of the first and second support arms, the second support member having first and second detents at respective transverse ends thereof.

12 Claims, 2 Drawing Sheets

HANGER FOR PLURAL PART GARMENTS

CROSS-REFERENCE TO RELATED APPLICATION

This application is a continuation-in-part of U.S. patent application Ser. No. 09/088,642, filed on Jun. 2, 1998 and entitled "Garment Hanger".

FIELD OF THE INVENTION

This invention relates generally to hangers for garments having plural parts and pertains more particularly to hangers for bathing suits.

BACKGROUND OF THE INVENTION

U.S. Pat. No. 4,703,878 ("the '878 patent") shows a hanger for underwear which has a transversely extending support member with a hook extending upwardly of the support member for engaging a support rail to suspend the support member. A plurality of garment interior support elements depend downwardly of the support member arcuately to the vertical and have hook formations on ends thereof to entrap an undergarment thereabove. At ends of the support member, the hanger includes downwardly and outwardly extending single garment support elements, i.e., exterior garment support elements, with projections extending outwardly of the exterior garment support elements. A notch or detent is formed in the support member above each of the exterior support elements. Such hanger exterior garment support elements are shown in U.S. design Pat. Des. No. 202,240.

The hanger of the '878 patent has facility for the hanging of underwear (briefs) of various waistband sizes. Underwear is hung by applying one end of its waistband to an interior garment support element above the hooked end thereof, drawing the waistband about one of the exterior garment support elements and then applying the other end of the waistband about the other of the exterior garment support elements and then applying the other end of the waistband to another of the interior support elements. Different interior garment support elements are used for differently-sized underwear.

South Africa Patent Application No. 85/7516, which is noted in the '878 patent as the first-filed application counterpart to the application for the '878 patent, describes a similar hanger structure wherein, however, the interior garment support elements depend straightwise from the support member, i.e., the elements are not arcuate.

By way of further background to the subject invention, note is taken of a commercially-known hanger for briefs bearing the legend "PLASTI-FORM-1-800-HANGER-4". This hanger also has garment support elements which extend downwardly and straightwise from the hanger support member, i. e., not arcuately to the vertical. Contrary to the hangers of the '878 patent and the above-noted South African patent application, each of which has hook formations at the lower ends of the garment support elements, the commercially-known hanger has a spring-like member extending continuously with the ends of the garment support elements vertically upwardly toward the support member.

Common to above-discussed hangers is to provide the support member in a downwardly arcuate configuration such that the support member is not seen when the hangers support underwear.

The parent '642 application noted above provides an upstanding garment hanger comprising a transversely extending support member and a succession of garment support elements depending downwardly from the support member to free ends, at least first and second adjacent ones of the garment support elements defining transversely extending, vertically spaced projections upwardly of the free ends thereof.

The projections of the first garment support element are in different vertical locations than the projections of the adjacent second garment support element and are preferably of semicircular configuration.

In use of the hanger, a waistband is inserted within a pair of the garment support elements and is engaged and retained by the projections of the garment support elements of such pair. The waistband is then drawn over one end of the support member, across the front of the support member, over the other end of the support member and is inserted rearwardly of the support member into the appropriate garment support element pair and retained by the projections of the garment support elements of such pair.

SUMMARY OF THE INVENTION

The present invention has as its object an extension of the hanger of the parent '642 application to facilitate the hanging of garments having plural parts, such as bathing suits.

In attaining this and other objects, the invention provides an upstanding garment hanger, comprising a transversely extending first support member, a succession of garment support elements depending downwardly from the first support member to free ends, at least first and second adjacent ones of the garment support elements defining transversely extending, vertically spaced projections upwardly of the free ends thereof, first and second support arms extending upwardly from the support member and a transversely extending second support member joined with upper ends of the first and second support arms, the second support member having first and second detents at respective transverse ends thereof.

The invention will be further understood from consideration of the following description of preferred embodiments thereof and from the drawings where like reference numerals identify like parts throughout.

DETAILED DESCRIPTION OF PREFERRED EMBODIMENTS

Figure 1:
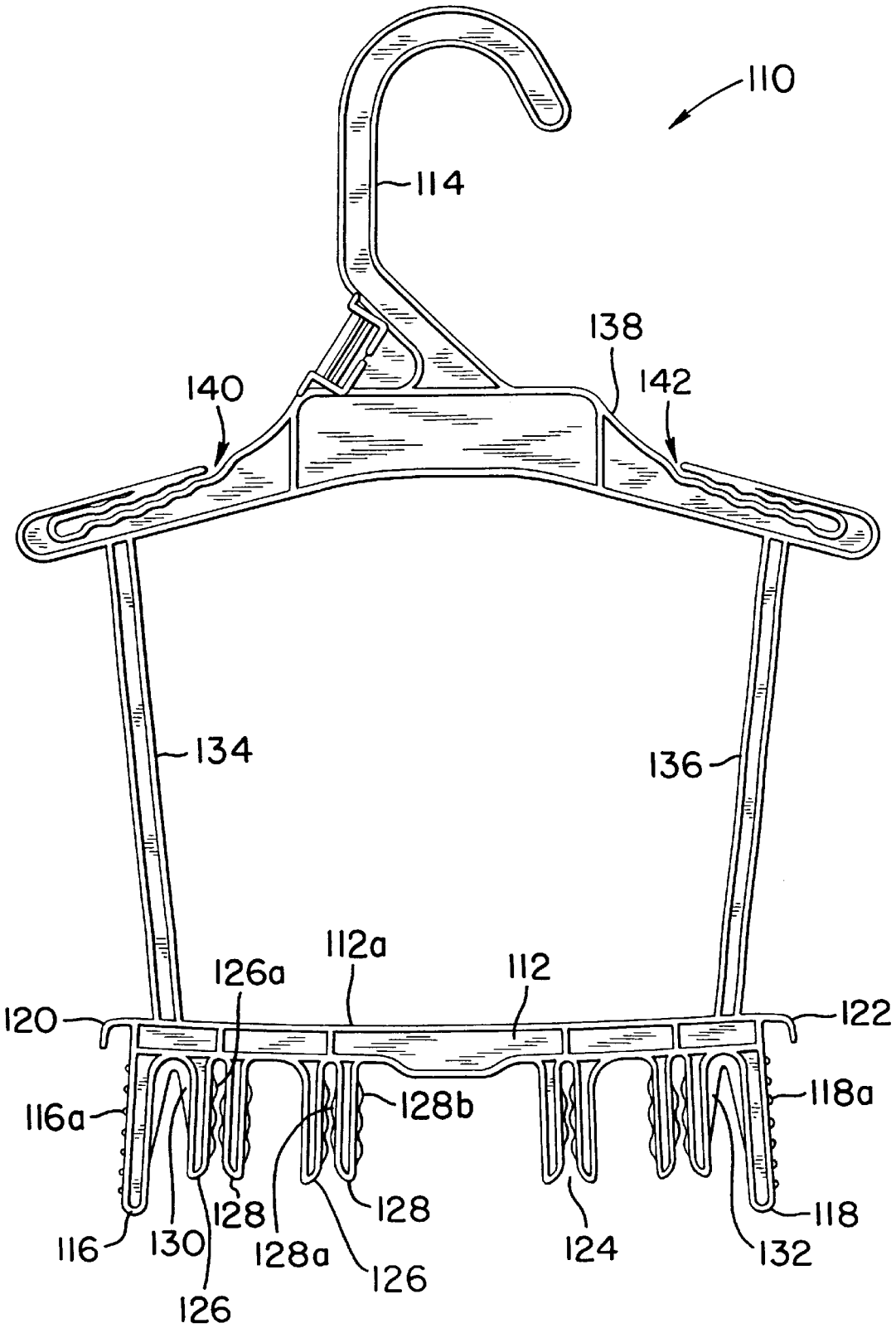
FIG. 1 is a rear elevation of a hanger in accordance with the invention.
Figure 2:
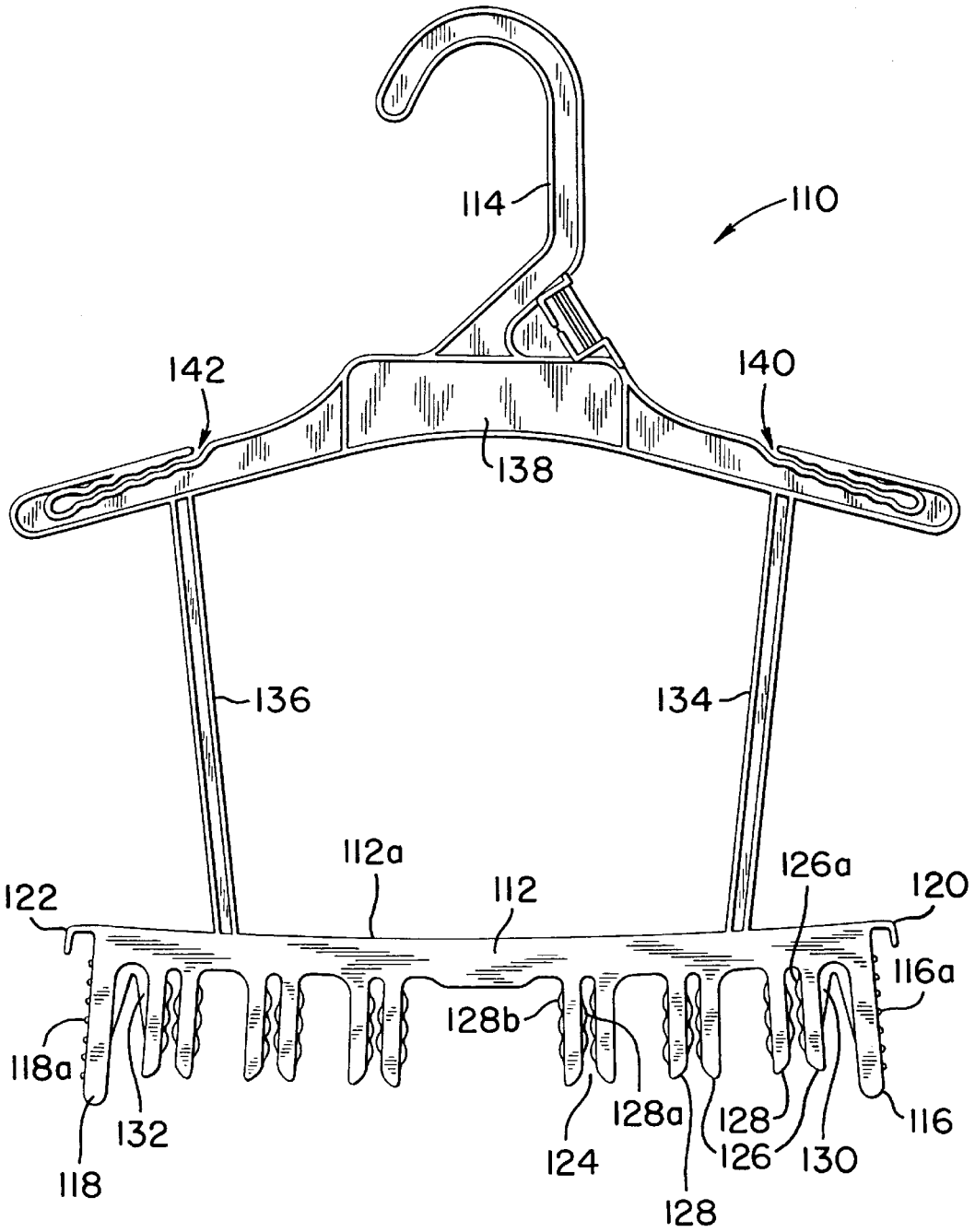
FIG. 2 is a front elevation of the FIG. 1 hanger.

Referring to FIGS. 1 and 2, upstanding garment hanger 110 is formed of plastic as a one-piece body, as by plastic molding. Hanger 110 includes a transversely extending first garment support member 112 and a hook 114 for receiving a display rod.

At ends of first support member 112 are garment guide members 116 and 118 which have respective outer surfaces with garment engaging dimples 116*a* and 118*a*. Detents 120 and 122 extend outwardly over guide members 116 and 118.

Interiorly of guide members 116 and 118, garment support elements depend in pairs 124 downwardly of first support member 112. Each pair of garment support elements includes a garment support element 126 and a garment support element 128. Stiffening ribs 130 and 132 are provided as illustrated.

Each of garment support elements 126 has projections 126*a* extending transversely outwardly thereof toward one of garment support elements 128. Each of garment support elements 128 has projections 128*a* extending transversely outwardly thereof toward one of garment support elements 126 and projections 128*b* extending oppositely transversely outwardly thereof.

Projections 126*a* of support element 126 are in different vertical locations than projections 128*a* of garment support element 128, and vice versa. In the preferred, illustrated embodiment, each of the projections of the second support element is vertically successive to a projection of the first garment support element. Further, projections 128*a* and 128*b* are in same vertical locations. All of projections 126*a*, 128*a* and 128*b* are preferably semicircular in configuration.

Lower ends of support arms 134 and 136 joined with first support member 112 and upper ends thereof are joined with a transversely extending second support member 138, which has first and second detents 140 and 142 at respective transverse ends thereof. First and second detents 140 and 142 comprise respective end portions of second support member 138 which have respective slots therein opening into a top surface of second support member 138. Each slot is bounded by opposed undulating interior surfaces of second support member 138.

In assembling a two-piece women's bathing suit hanger 110, a waistband end of the bottom bathing suit piece is inserted within a pair of the garment support elements and is engaged and retained by the projections of the garment support elements of such pair. The waistband is then drawn over guide member 118 interiorly of detent 122, across the front of support member 112, over guide member 116 interiorly of detent 120 and then the other waistband end is inserted into another selected pair of garment support elements, being first drawn over projections 128*b* thereof and retained by the projections of such pair of garment support elements. Since support member 112 is configured to be downwardly arcuate in its surface 112*a*, it is not seen in viewing the front of the hanger with the bottom bathing suit piece assembled therewith.

The upper piece, e.g., the bra, of the bathing suit has its straps now inserted into detents 140 and 142 and thereby secured to the hanger.

Arms 134 and 136 are desirably selected to be of such length that, upon assembling the upper piece of the bathing suit with the hanger, the lower portion of the bra extends in covering relation to the bottom bathing suit piece.

From the foregoing, the invention will be seen to provide an upstanding garment hanger comprising a transversely extending first support member and a succession of garment support elements depending downwardly from the support member to free ends, at least first and second adjacent ones of the garment support elements defining transversely extending, vertically spaced projections upwardly of the free ends thereof, and a transversely extending second support member, which has first and second detents at respective transverse ends thereof.

From another perspective, the invention will be seen to provide an upstanding garment hanger, comprising a transversely extending first support member and a succession of transversely spaced pairs of garment support elements depending downwardly from the support member to free ends, the garment support elements of each of the spaced pairs defining transversely extending, vertically spaced projections upwardly of the free ends thereof, and a transversely extending second support member, which has first and second detents at respective transverse ends thereof.

Also, the invention will be seen to provide an upstanding garment hanger, comprising a transversely extending first support member and a succession of transversely spaced pairs of garment support elements depending downwardly from the support member to free ends, one garment support element of each of the spaced pairs of having projections extending transversely outwardly of both vertical sides thereof and the other garment support element of each of the spaced pairs having projections extending transversely outwardly of one vertical side toward the one garment support element, and a transversely extending second support member, which has first and second detents at respective transverse ends thereof.

Various changes to the particularly depicted embodiment of the invention may be introduced without departing from the scope of the invention. By way of example, the hook portion of the hanger may or may not include a so-called "side sizer system" (144) whereby a size marker may mounted on the hanger in a self-locking manner as is shown in U.S. Pat. No. 5,687,887, to which incorporating reference is made. Accordingly, it is to be appreciated that the particularly disclosed embodiments are intended in an illustrative, and not in a limiting, sense. The true spirit and scope of the invention is set forth in the ensuing claims.

What is claimed is:

1. An upstanding garment hanger, comprising:

a transversely extending first support member;

a succession of garment support elements depending downwardly from the first support member to free ends, at least first and second adjacent ones of the garment support elements defining transversely extending, vertically spaced projections upwardly of the free ends thereof;

first and second support arms extending upwardly from the support member; and a transversely extending second support member joined with upper ends of the first and second support arms, the second support member having first and second detents at respective transverse ends thereof.

2. The garment hanger claimed in claim 1, wherein the projections of the first garment support element are in different vertical locations than the projections of the second garment support element.

3. The garment hanger claimed in claim 2, wherein each of the projections of the second garment support element is vertically successive to a projection of the first garment support element.

4. The garment hanger claimed in claim 1, wherein the projections are semicircular in configuration.

5. The garment hanger claimed in claim 4, wherein the projections of semicircular configuration of the first garment support element are in different vertical locations than the projections of the second garment support element.

6. The garment hanger claimed in claim 4, wherein each of the projections of semicircular configuration of the second garment support element is vertically successive to a projection of semicircular configuration of the first garment support element.

7. The garment hanger claimed in claim 1, further including garment guide members located at opposite transverse ends of the support member.

8. The garment hanger claimed in claim 1, wherein the first and second detents comprise respective end portions of the second support member having respective slots therein opening into a top surface of the second support member.

9. The garment hanger claimed in claim 8, wherein each the slot is bounded by opposed undulating interior surfaces of the second support member.

10. The garment hanger claimed in claim 1, further including a hook extending upwardly of the second support member.

11. An upstanding garment hanger, comprising:

a transversely extending first support member;

a succession of transversely spaced pairs of garment support elements depending downwardly from the first support member to free ends, the garment support elements of each of the spaced pairs defining transversely extending, vertically spaced projections upwardly of the free ends thereof;

a transversely extending second support member joined with upper ends of the first and second support arms, the second support member having first and second detents at respective transverse ends thereof.

12. An upstanding garment hanger, comprising:

a transversely extending first support member;

a succession of transversely spaced pairs of garment support elements depending downwardly from the support member to free ends, one garment support element of each of the spaced pairs of having projections extending transversely outwardly of both vertical sides thereof and the other garment support element of each of the spaced pairs having projections extending transversely outwardly of one vertical side toward the one garment support element;

a transversely extending second support member joined with upper ends of the first and second support arms, the second support member having first and second detents at respective transverse ends thereof.

* * * * *